US005573153A

United States Patent [19]

Stillman

[11] Patent Number: 5,573,153

[45] Date of Patent: Nov. 12, 1996

[54] FEEDING CLOTH

[75] Inventor: Penny S. Stillman, New Hope, Minn.

[73] Assignee: Mother In Motion, Inc., New Hope, Minn.

[21] Appl. No.: 389,275

[22] Filed: Feb. 9, 1995

[51] Int. Cl.[6] ..... A45F 5/00

[52] U.S. Cl. ..... 224/148.6; 224/148.4; 224/148.1; 224/901.4; 224/605; 248/102

[58] Field of Search ..... 224/148, 901, 224/202, 203, 205, 264, 603, 601, 602, 148.1, 148.7, 600, 605, 901.4, 901.8; 248/102, 104

[56] References Cited

U.S. PATENT DOCUMENTS

| | | | |
|---|---|---|---|
| 546,033 | 9/1895 | Shepard . | |
| 1,110,694 | 9/1914 | Jennings | 224/603 |
| 2,617,105 | 11/1952 | Backman | 224/148 |
| 2,672,263 | 3/1954 | Alber | 224/205 |
| 2,893,672 | 7/1959 | Vardan | 248/102 |
| 2,907,539 | 10/1959 | Vardan | 248/104 |
| 2,938,693 | 5/1960 | Vardan | 248/104 |
| 3,977,638 | 8/1976 | Woodard . | |
| 4,220,302 | 9/1980 | Hampton et al. | 224/148 |
| 4,498,613 | 2/1985 | Donahue et al. . | |
| 4,537,341 | 8/1985 | Kelly | 224/148 |
| 4,564,957 | 1/1986 | Scharf . | |
| 4,911,347 | 3/1990 | Wilhite | 224/264 |
| 5,240,156 | 8/1993 | Sicotte et al. | 224/148 |

FOREIGN PATENT DOCUMENTS

| | | | |
|---|---|---|---|
| 1352252 | 1/1964 | France | 224/203 |
| 109705 | 3/1900 | Germany | 224/205 |
| 18955 | of 1900 | United Kingdom | 224/203 |
| 2251544 | 7/1992 | United Kingdom | 224/203 |

*Primary Examiner*—Henry J. Recla
*Assistant Examiner*—Gregory M. Vidovich
*Attorney, Agent, or Firm*—Merchant, Gould, Smith, Edell, Welter & Schmidt, P.A.

[57] ABSTRACT

A feed cloth and bottle combination includes a cloth sized to be draped over a user's shoulder. An area of the cloth includes a first of a hook and loop fastener. A strap is secured to a baby bottle with an exterior surface of the strap having a second of a hook and loop fastener such that the strap and the bottle can be secured to the cloth with the bottle held in any desired orientation.

2 Claims, 3 Drawing Sheets

FEEDING CLOTH

I. BACKGROUND OF THE INVENTION

1. Field of the Invention

This invention pertains to a feeding cloth for supporting a nursing bottle.

2. Description of the Prior Art

When feeding an infant with a bottle, a parent holds the infant with one arm and holds the bottle with a free hand. From time to time, it is desirable to perform other tasks (such as holding a phone or the like) without interrupting the feeding of the infant. Also, for others (e.g., wheelchair-bound people) such a function is desired.

Apparatus for holding bottles are known in the prior art. For example, U.S. Pat. No. 4,564,957 to Scharf issued Jan. 21, 1986, discloses a baby bottle security garment. The garment is worn by a child and includes a sleeve for removably receiving and securing a baby bottle. A strap member secures the sleeve to the garment. In one embodiment, a sleeve retaining assembly comprises a belt with a hook and loop fastener (for example, a Velcro™ fastener) attached to both ends. The assembly is secured to the garment and wraps around the sleeve to secure the nursing bottle to the garment. In an alternative, both the garment and the sleeve have Velcro patches. When pressed together, the Velcro patches secure the sleeve to the garment. Even when pulled away from the garment, the bottle remains secured to the garment by means of the strap. Unfortunately, in the '957 patent, the orientation of the baby bottle is restricted to a vertical orientation. As a result, the design is not susceptible for use with an infant and does not permit a wide variety of orientations of the infant relative to the parent or the garment.

U.S. Pat. No. 3,977,638 to Woodard dated Aug. 31, 1979, teaches a nursing bottle which is supported by a halter worn around the neck. Unfortunately, the angular positioning of the bottle with respect to the parent cannot be adjusted. As a result, when the feeding is interrupted the bottle continues to be pointed in a downward direction resulting in leakage.

U.S. Pat. No. 4,498,613 to Donahue et al., dated Feb. 12, 1985, is a support device for nursing bottles. The device includes a resilient and adjustable strap. Again, there is no mechanism in the '613 patent for fixing the bottle in any one of a plurality of orientations.

It is an object of the present invention to provide a mechanism for permitting a parent to feed an infant and to releasably hold a bottle in any one of a plurality of orientations.

II. SUMMARY OF THE INVENTION

According to a preferred embodiment to the present invention, a feeding cloth is disclosed which extends from a first end to a second end. The cloth has a first surface and an opposite back surface. The cloth is sized to be draped over a user's shoulder with the first end facing the user's chest and with the second end facing the user's back. An area of the first surface adjacent the first end is provided with at least one of a hook and loop fastener fabric. A strap surrounds a baby bottle with an exterior of the strap having the other of the hook and loop fastener fabric. The strap is snugly fitted onto the bottle with the fastener of the strap releasably adhered to the fastener of the cloth.

III. BRIEF DESCRIPTION OF THE DRAWINGS

IV. DESCRIPTION OF THE PREFERRED EMBODIMENT

Referring now to the several drawing figures in which identical elements are numbered identically throughout, a description of the preferred embodiment of the present invention will now be provided.

Figure 1:
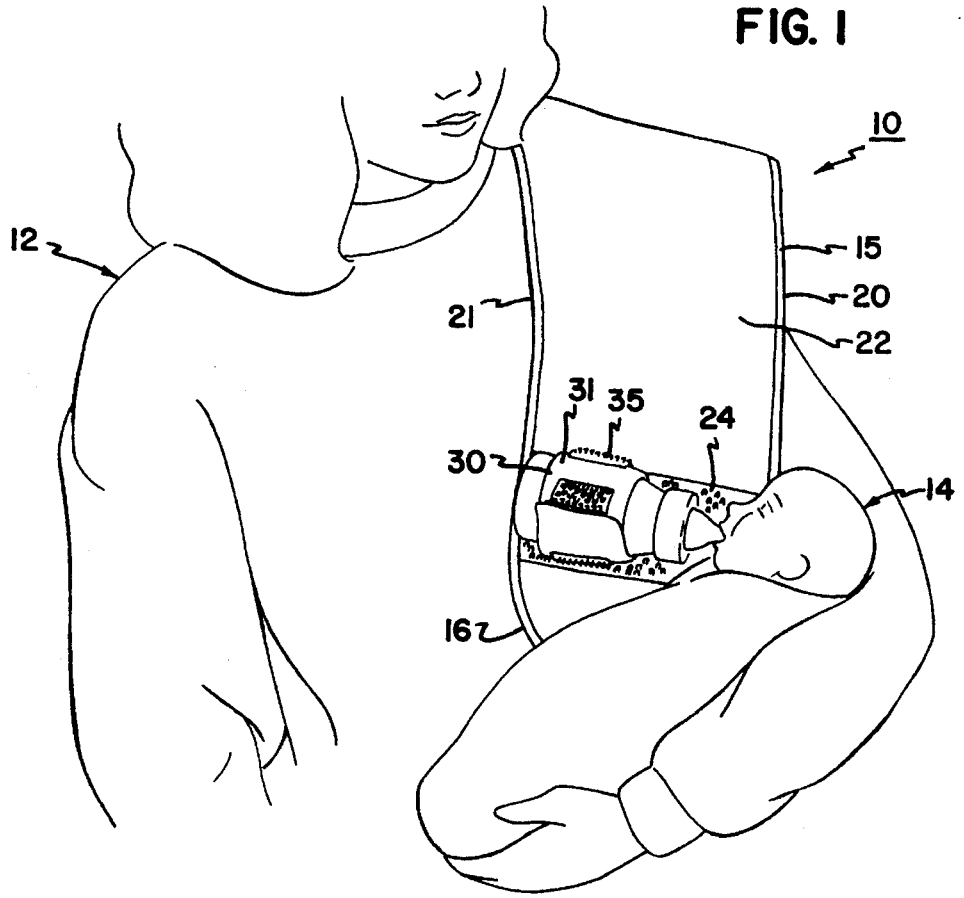
FIG. 1 is a view of a feeding cloth being worn and used by a parent feeding an infant.
Figure 2:
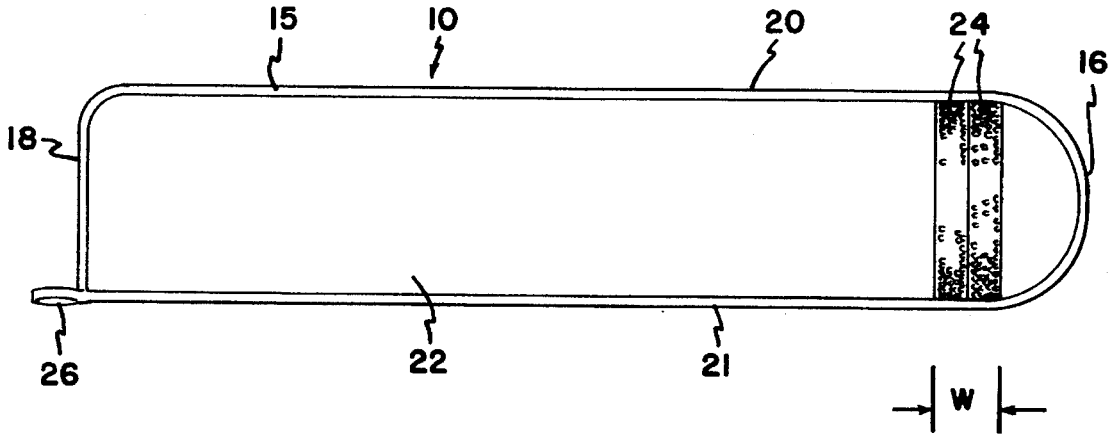
FIG. 2 is a plan view of the feeding cloth of the present invention.
Figure 3:
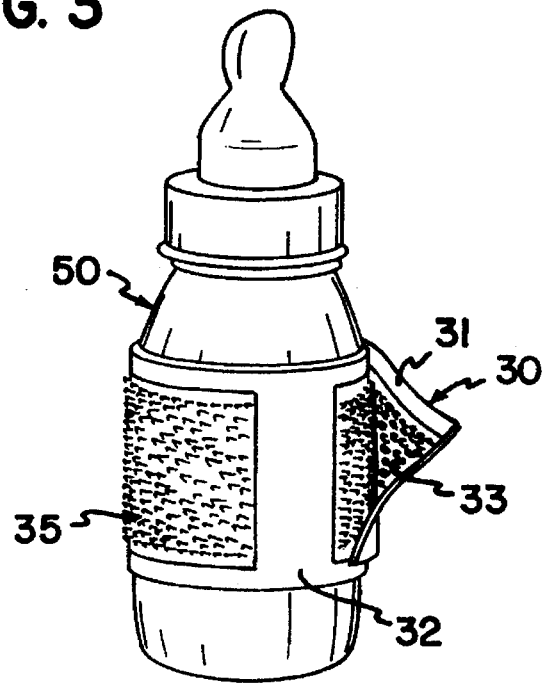
FIG. 3 is a view of a bottle having a strap for use with the present invention.

With initial reference to FIG. 1, a feeding cloth is shown begin used by a parent 12 for feeding an infant 14. The feeding cloth 10 is a generally rectangular terry cloth which is flexible and extends from a first end 16 to a second end 18 (FIG. 2). The ends 16 and 18 are connected by side edges 20, 21. The cloth presents a first or outer surface 22 and a rear surface 24. Ends 16, 18 and edges 20, 21 are covered with a border 15 of fabric. The cloth border 25 terminates at a loop 26 at end 18 such that with loop 26, the cloth 10 can be hung on a hook or the like for storage.

In a preferred embodiment, the length of the cloth (i.e., the distance between ends 16, 18) is about 27.5 inches. The width of the cloth (i.e., the distance between side edges 20, 21) is about 10 inches.

First surface 22 adjacent first end 16 is provided with fabric straps 24 which preferably are the hook portion of a hook and loop type fastener. A common example of such fasteners is the Velcro brand hook and loop fastener. The fasteners 24 extend the entire width of the cloth and have a width W of 3 inches.

The feeding cloth 10 of the present invention includes a strap 30 having an inside surface 31 covered with a hook portion 33 of a hook and loop fastener and an exterior surface 32 covered with a fabric 35 which is the loop portion of a hook and loop fastener. The strap 30 is sized that it may be wrapped around a baby bottle 50.

The strap 30 is snugly secured to the baby bottle 50 by having the hook fastener 33 attached to the loop fastener 35 with the strap 30 snugly secured on the bottle 50. Thus arranged, the strap 50 presents a loop fastener portion 35 surrounding bottle 50 which permits the bottle 50 to be affixed to hook fastener portion 24 on cloth 10. Thus, the bottle 50 may be releasably secured to cloth 10 in any desired orientation.

In FIG. 1, the bottle 50 is shown in an orientation to permit the baby 14 to be fed with the parent 12 having a free hand for performing other tasks. If it were to be desired to interrupt the feeding but continue to have a free hand, the orientation of the bottle 50 can be easily changed to be a vertical orientation and still be secured to the fabric fastener 24 on cloth 10.

Figure 4:
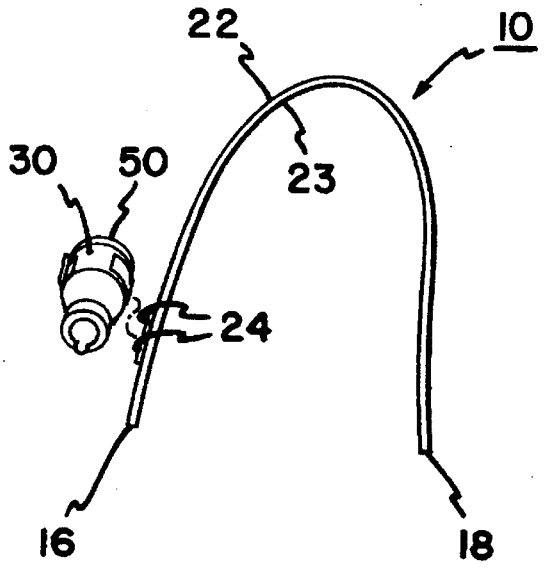
FIG. 4 is a side view of the bottle in feeding cloth of FIG. 1 shown without a user.

As shown in FIG. 4, the second end 18 of the feeding cloth 10 will oppose the back of the wearer 12 when the cloth is substantially folded in half and draped over a shoulder of the wearer. The front edge 16 opposes the chest of the wearer.

Figure 5:
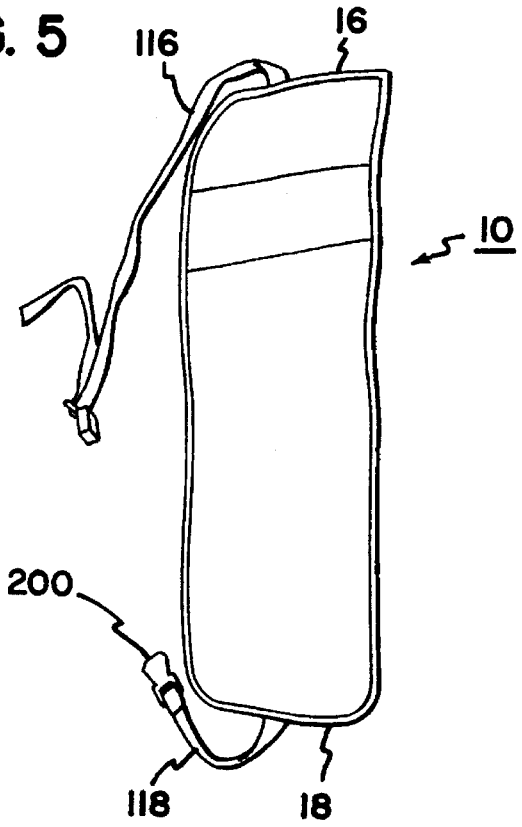
FIG. 5 is a perspective view of the feeding cloth of FIG. 2 with straps added to ends of the cloth.

When the baby bottle 50 is secured to the cloth 24, the weight of the baby bottle 50 (when full) would have a tendency to cause the cloth 10 to fall off of the shoulder of the wearer. To this end, the end 18 should be of sufficient weight to resist such movement. The weight can be provided by Simply placing weighted material within the fabric of the cloth 10. However, in a preferred embodiment, the length of the cloth 10 is selected such that the terry cloth draped over the back of the wearer and the shoulder of the wearer presents sufficient frictional force opposing any slippage of the cloth 10 in response to the weight of the bottle 50. Alternatively, the ends 16, 18 can be provided with straps 116, 118 (alternate embodiment shown in FIG. 5) which may be releasably joined by a clip 200. The straps would surround the torso of the wearer beneath the shoulder opposite the shoulder on which the cloth is worn. (See FIG. 7).

Figure 6:
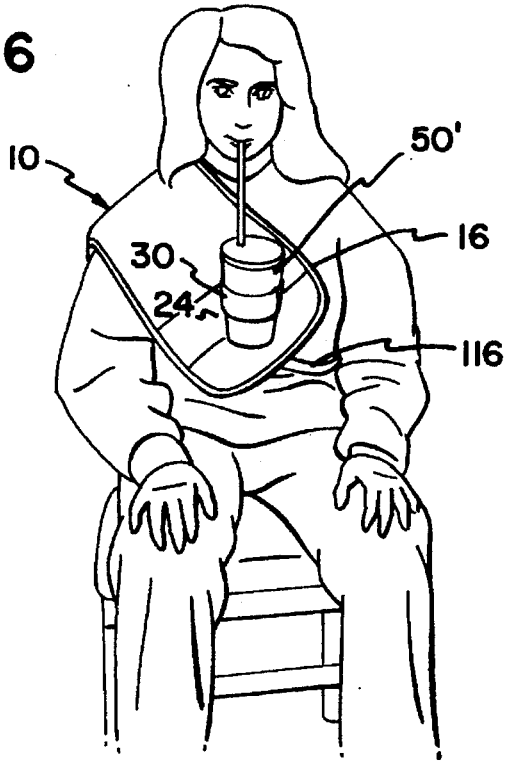
FIG. 6 is a perspective view of an adult utilizing the invention of FIG. 5.

From the foregoing detailed description of the present invention, it has been shown how the objects of the invention have been attained in a preferred manner. In addition to holding the bottle at any orientation, the feeding cloth can be used to burp a child. However, modifications and equivalents of the disclosed concepts such as readily occur to one skilled in the art are intended to be included within the scope of the claims. For example, the present invention could be used for wheelchair bound persons to hold beverage containers 50' (FIG. 6).

What is claimed is:

1. A feed cloth and beverage container comprising:

an absorbent cloth extending from a first end to a second end and having a transverse dimension from a first side edge to a second side edge, said cloth having a first surface and an opposite back surface, said transverse dimension sized for said first side edge to be disposed over a shoulder surface of one of a user's shoulders, the shoulder surface having a length laterally extending from the base of the user's neck adjacent the one shoulder to an outer, upper point of the user's arm adjacent the one shoulder and furtherst from the base of the neck, said transverse dimension being substantially uniform over the length of said cloth between said first and second ends and being greater than said shoulder length such that said first side edge lies directly adjacent the base of the user's neck and the second side edge laterally extends beyond the point when said cloth is worn by the user;

an area of said first surface adjacent said first end provided with at least a first one of a hook and loop type fastener fabric, said area sized to extend substantially an entire width of said traverse dimension;

a strap sized to extend around a beverage container and having an exterior surface of a second one of said hook and loop type fastener fabric;

a beverage container with said strap snugly fitted on said container and with said second one of said hook and loop type fastener fabric exposed surrounding said container;

said cloth sized to substantially cover and drape over a user's shoulder with said first end facing said user's chest and with said second end facing said user's back and with a friction of said cloth against said user restricting movement of said cloth relative to said user in response to a weight of said container on said cloth.

2. A feed cloth and beverage container according to claim 1 wherein said strap includes an interior surface with said first one of said hook and loop fastener fabric on said interior surface and releasably secured to said exterior surface for securing said strap onto the beverage container.

* * * * *